US008651286B2

(12) United States Patent
Shooshtari et al.

(10) Patent No.: US 8,651,286 B2
(45) **Date of Patent: *Feb. 18, 2014**

(54) SPUNBOND POLYESTER MAT WITH BINDER COMPRISING SALT OF INORGANIC ACID

(75) Inventors: Kiarash Alavi Shooshtari, Littleton, CO (US); James Patrick Hamilton, Horseheads, NY (US); Jawed Asrar, Englewood, CO (US)

(73) Assignee: Johns Manville, Denver, CO (US)

( * ) Notice: Subject to any disclaimer, the term of this patent is extended or adjusted under 35 U.S.C. 154(b) by 337 days.

This patent is subject to a terminal disclaimer.

(21) Appl. No.: 12/969,217

(22) Filed: Dec. 15, 2010

(65) Prior Publication Data

US 2012/0152826 A1 Jun. 21, 2012

(51) Int. Cl.

| | |
|---|---|
| ***B01D 39/16*** | (2006.01) |
| ***B05D 3/02*** | (2006.01) |
| ***D04H 3/12*** | (2006.01) |
| ***H01M 2/18*** | (2006.01) |

(52) U.S. Cl.

USPC ..... 210/505; 55/527; 55/528; 210/508; 52/309.1; 427/389.9; 427/394; 428/96; 428/97; 428/311.51; 429/249

(58) Field of Classification Search

USPC ..... 55/527, 528; 429/247, 249, 254; 52/309.1; 427/389.9, 393.5, 394; 442/394, 395, 401; 428/96, 97, 428/295.1–299.7, 311.51, 311.71, 375, 428/392–395

See application file for complete search history.

(56) References Cited

U.S. PATENT DOCUMENTS

| | | | | |
|---|---|---|---|---|
| 2,915,418 | A * | 12/1959 | Wolfrom | 523/206 |
| 3,140,265 | A * | 7/1964 | Richter, Jr. et al. | 428/97 |
| 3,438,931 | A * | 4/1969 | Mitchell et al. | 524/509 |
| 3,872,051 | A * | 3/1975 | Tiedeman et al. | 524/441 |
| 3,920,613 | A * | 11/1975 | Freeman et al. | 525/503 |
| 4,183,997 | A * | 1/1980 | Stofko | 428/326 |
| 4,524,164 | A * | 6/1985 | Viswanathan et al. | 524/14 |
| 4,692,478 | A * | 9/1987 | Viswanathan et al. | 527/300 |
| 5,180,647 | A * | 1/1993 | Rowland et al. | 429/252 |
| 5,243,015 | A * | 9/1993 | Hutchings et al. | 528/129 |
| 6,114,262 | A * | 9/2000 | Groh et al. | 442/366 |
| 6,194,477 | B1 * | 2/2001 | Cawse et al. | 521/76 |
| 7,029,516 | B2 * | 4/2006 | Campbell et al. | 95/90 |
| 7,655,711 | B2 * | 2/2010 | Swift et al. | 524/14 |
| 7,709,557 | B2 * | 5/2010 | Medoff et al. | 523/129 |
| 7,772,347 | B2 * | 8/2010 | Swift et al. | 527/312 |
| 7,807,771 | B2 | 10/2010 | Swift et al. | |
| 7,888,445 | B2 | 2/2011 | Swift et al. | |
| 8,299,174 | B2 * | 10/2012 | Brady et al. | 525/54.3 |
| 2003/0079833 | A1 * | 5/2003 | Pirhonen et al. | 156/335 |

(Continued)

FOREIGN PATENT DOCUMENTS

| | | | |
|---|---|---|---|
| DE | 10 2004 033561 | A1 | 9/2005 |
| EP | 1 510 607 | A1 | 3/2005 |
| EP | 2 223 941 | A1 | 9/2010 |
| GB | 2 451 719 | A | 2/2009 |

*Primary Examiner* — Joseph Drodge
(74) *Attorney, Agent, or Firm* — Robert D. Touslee

(57) ABSTRACT

Provided are spunbond polyester mats using an improved curable composition. Such curable composition comprises the reaction product of an aldehyde or ketone and an amine salt of an inorganic acid. The composition when applied to spunbond polyester continuous filaments is cured to form a water-insoluble polymer binder which exhibits good adhesion and thermodimensional stability.

19 Claims, 1 Drawing Sheet

(56) References Cited

U.S. PATENT DOCUMENTS

| | | | | |
|---|---|---|---|---|
| 2004/0166144 | A1* | 8/2004 | Besemer et al. | 424/443 |
| 2005/0191924 | A1* | 9/2005 | Taylor et al. | 442/331 |
| 2007/0027283 | A1 | 2/2007 | Swift et al. | |
| 2007/0043173 | A1* | 2/2007 | Pirhonen et al. | 525/480 |
| 2007/0123679 | A1* | 5/2007 | Swift et al. | 527/312 |
| 2007/0123680 | A1* | 5/2007 | Swift et al. | 527/312 |
| 2008/0145637 | A1* | 6/2008 | Frank | 428/292.4 |
| 2009/0011214 | A1* | 1/2009 | Wang | 428/305.5 |
| 2009/0104458 | A1* | 4/2009 | Ryu | 428/446 |
| 2009/0317626 | A1* | 12/2009 | Tiarks et al. | 428/331 |
| 2009/0324915 | A1 | 12/2009 | Swift et al. | |
| 2010/0084598 | A1 | 4/2010 | Jackson et al. | |
| 2010/0086728 | A1 | 4/2010 | Theurl et al. | |
| 2010/0222459 | A1* | 9/2010 | Kelly et al. | 524/17 |
| 2010/0301256 | A1* | 12/2010 | Hampson et al. | 252/62 |
| 2011/0009530 | A1* | 1/2011 | Kasmayr et al. | 524/13 |

* cited by examiner

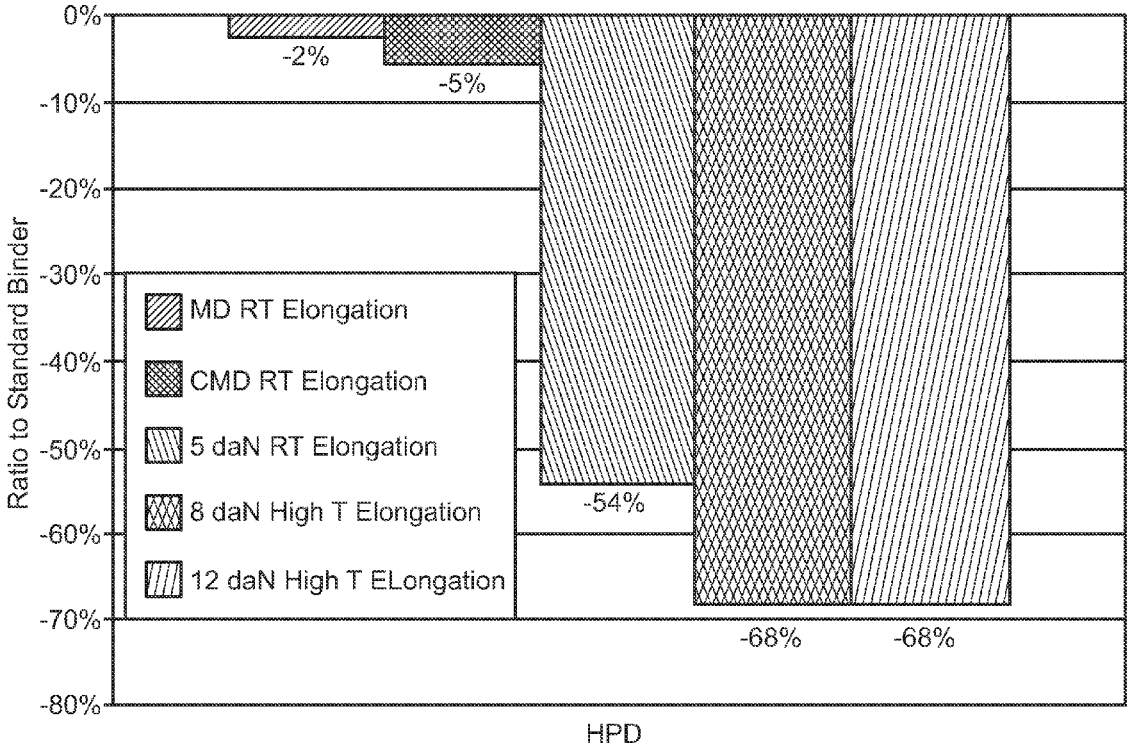
0%
-10%
-20%
-30%
-40%
-50%
-60%
-70%
-80%
Ratio to Standard Binder
-2%
-5%
-54%
-68%
-68%
MD RT Elongation
CMD RT Elongation
5 daN RT Elongation
8 daN High T Elongation
12 daN High T ELongation
HPD

SPUNBOND POLYESTER MAT WITH BINDER COMPRISING SALT OF INORGANIC ACID

BACKGROUND

The subject invention pertains to spunbond polyester mats with an improved binding composition. More specifically, the invention pertains to spunbond polyester mats using an improved curable composition comprising an amine salt of an inorganic acid. An aldehyde or ketone is added to the salt to form a composition which upon curing is capable of forming a water-insoluble polymer. Once applied to the polymer fibers, the binding composition is cured.

Spunbond polyester nonwovens are known and commercially available. The unique technology process creates products with the excellent properties of a uniform surface, tear strength and high porosity. Polyester spunbond is a manufactured sheet of randomly oriented polyester filaments bonded by calendaring, needling, chemically with a binder, or a combination of these methods. In general, small diameter filaments are formed by extruding one or more molten polyester fibers from a spinneret. The extruded fibers are cooled while being drawn to form spunbond fibers or continuous filaments, which are deposited or laid onto a forming surface in a random manner to form a loosely entangled web. This web is then subjected to a bonding process.

When a binder is used thermosetting binders are employed as bonding agents in curable polyester spunbond mats for reinforcement applications. Generally, latex binders have been employed to bind polyester fibers. These latex binders are crosslinked via several mechanisms including formation of ester, ether, alkyl, epoxy and urethane linkages. Most latex binders are crosslinked via addition of a formaldehyde based crosslinker. Since formaldehyde is a known respiratory and skin irritant as well as a suspected carcinogen, it is desirable to eliminate formaldehyde based binders from the manufacturing process for these products. While other formaldehyde free binders are available to produce spunbond products, these binders typically result in reduced physical performance or greater difficulty in processing the mat. Thus, it is highly desirable to have a mat binder that does not contain formaldehyde in its formulation or a binder that produces or generates formaldehyde in the curing or crosslinking step. Such a binder should process easily and demonstrate equivalent performance to formaldehyde-based binders. Although existing binders provide adequate tensile and tear strength to the spunbond mat, thermal dimensional stability (TDS) requirements at temperatures above 180° C. can not be met and as a result, fiberglass scrim reinforcement is often required.

Accordingly, in one aspect the present invention provides a spunbond polyester mat comprised of a binder which is free of formaldehyde.

Another aspect of the invention provides a novel spunbond polyester mat with a formaldehyde free binder that processes easily and provides at least comparable tensile and tear strength to the mat.

Still another aspect of the present invention is to provide a spunbond polyester mat which uses a suitable binder having improved economics, while also enjoying improved thermal dimensional stability.

These and other aspects of the present invention will become apparent to the skilled artisan upon a review of the following description and the claims appended hereto.

SUMMARY OF THE INVENTION

Provided is a spunbond polyester mat. The binder is a curable composition comprising a mixture of an aldehyde or ketone and an amine salt of an inorganic acid. This composition upon curing is capable of forming a water-insoluble polymer.

A process for preparing the spunbond polyester mat is also provided, comprising applying to the polyester continuous filaments a composition as a binder comprising an aldehyde or ketone and an amine salt of an inorganic acid. Thereafter the composition is cured while present on the filaments to form a water-insoluble polymer.

In a preferred embodiment the resulting spunbond polyester mat is used in a roofing membrane or in a filter.

BRIEF DESCRIPTION OF THE FIGURE OF THE DRAWING

Machine and cross-machine direction tensile elongation and elevated temperature relative tensile elongation of a HMDA/Phos/Dextrose binder are graphically expressed as a ratio to a standard latex binder system. The MD and CMD tensile elongation tests were conducted at room temperature. The relative tensile elongation tests were conducted at 200° C. and the absolute elongation is determined at tensile loadings of 5, 8, and 12 daN, respectively.

DETAILED DESCRIPTION OF PREFERRED EMBODIMENTS

Spunbond polyester nonwovens are known. Spunbond polyester webs or mats can be used in many applications, particularly in roofing membranes and filters. The webs or mats can be used in any roofing application, e.g., in a flat roof, pitched rood or shingles. The filters can be for air filtration, liquid filtration and in a mist eliminator for sub-micro particles. The spunbond polyester webs or mats can also be utilized in flooring applications, wallcoverings, deco and technical yarns, geotextiles, the automotive industry, for heat absorption applications, insulation and lamination, pipewrap as well as batteries.

In general, spunbond polyester mats are prepared by extruding polyester polymers into continuous filament strands that are arranged uniformly in multiple layers, using an overlapping pattern to give the mat dimensional strength. A binder is added to the continuous filament strands to help strength and maintain integrity of the mat.

The binder of the present invention which is employed to prepare the polyester spunbond mat is a curable composition comprising an aldehyde or ketone and an amine salt of an inorganic acid.

The salt can be any amine salt of an inorganic acid, e.g., an amine acid salt. Any suitable inorganic acid can be used. The acids can be oxygenated acids or non-oxygenated acids. Examples of suitable oxygenated acids include, but are not limited to, phosphoric acid, pyrophosphoric acid, phosphorus acid, nitric acid, sulfuric acid, sulfurous acid, boric acid, hypochloric acid and chlorate acid. Examples of non-oxygenated acids include, but are not limited to, hydrochloric acid, hydrogen sulfide and phosphine. Phosphoric acid is most preferred.

The salt can be prepared using any conventional technique to create salts of inorganic acids. Amine-acid salts are obtained by reacting the selected amine with the acid in water. This is a very simple and straightforward reaction. The molar ratio of acid functionality to amine functionality can vary, and is generally from 1:25 to 25:1. More preferred is a ratio of from 1:5 to 5:1, with a ratio of about 1:2 to 2:1 being most preferred.

Examples of amines include, but are not limited to, aliphatic, cycloaliphatic and aromatic amines. The amines may be linear or branched. The amine functionalities may be di- or multifunctional primary or secondary amines. The amines can include other functionalities and linkages such as alcohols, thiols, esters, amides, acids, ethers and others.

Representative amines that are suitable for use in such an embodiment include 1,2-ethylenediamine, 1,3-propanediamine, 1,4-butanediamine, 1,5-pentanediamine, 1,6-hexanediamine, α,α-diaminoxylene, diethylenetriamine, triethylenetetramine, tetraethylenepentamine, and mixtures of these. Preferred diamines for use in this embodiment of the invention are 1,4-butanediamine and 1,6-hexanediamine. Natural and synthetic amino acids such as lysine, arginine, histidine, etc can also be used. The use of amines to prepare amine acid salts in accordance with the invention, as compared to the use of ammonia to prepare ammonium salts, provides one with superior binders in terms of strength.

To the solution of amine salt of inorganic acid, the carbonyl functional materials can be added, especially an aldehyde or ketone. Due to their higher reactivity, aldehydes are preferred to ketones. The composition comprises the amine salt of an inorganic acid and the aldehyde and/or ketone. Some small amount of reaction does take place within the composition between the components. However, the reaction is completed during the curing step, followed by the cross-linking reaction of curing.

Examples of suitable aldehydes include, but are not limited to, mono- and multifunctional aldehydes including acetaldehyde, hydroxy acetaldehyde, butyraldehyde, acrolein, furfural, glyoxal, glyceraldehyde, glutaraldehyde, polyfurfural, poly acrolein, copolymers of acrolein and others. Reducing mono, di- and polysaccharides such as glucose, maltose, celobiose etc. can be used, with reducing monosaccharides such as glucose being preferred.

Examples of ketones include, but are not limited to, acetone, acetyl acetone, 1,3 dihydroxy acetone, benzil, bonzoin, fructose, etc.

The carbonyl compound, i.e., the aldehyde or ketone, reacts with the amine salt of the inorganic acid. The amount of aldehyde and/or ketone added is generally such that the molar ratio of acid in the amine acid salt intermediate to carbonyl or ketone is from 1:50 to 50:1. A ratio of 1:20 to 20:1 is more preferred, with a ratio of 1:10 to 10:1 being even more preferred, and with a ratio of 1:3 to 1:8 being most preferred.

The binder composition when applied to the spunbond polyester filaments optionally can include adhesion promptters, oxygen scavengers, solvents, emulsifiers, pigments, fillers, anti-migration aids, coalescent aids, wetting agents, biocides, plasticizers, organosilanes, anti-foaming agents, colorants, waxes, suspending agents, anti-oxidants, crosslinking catalysts, secondary crosslinkers, and combinations of these.

Among the catalysts are salts of strong acids, either organic or inorganic, with salts of inorganic acids, such as phosphoric acid, sulfuric acid, nitric acid and halogenated acid, being preferred. These suitable catalysts include sodium or ammonium phosphate, sodium or ammonium sulfate, sodium or ammonium nitrate and sodium or ammonium chloride. The catalyst generally comprises from 2 to 8 wt % of the total binder composition, and more preferably from 4 to 6 wt % of the total binder composition.

The binder composition of the present invention can be applied to the spunbond polyester filaments by a variety of techniques. In preferred embodiments these include spraying, spin-curtain coating, and dipping-roll coating. The composition can be applied to freshly-formed polyester filaments, or to the polyester filaments following collection. Water or other solvents can be removed by heating.

Thereafter the composition undergoes curing wherein a strong binder is formed which exhibits good adhesion to the polyester filaments. Such curing can be conducted by heating. Elevated curing temperatures on the order of 100 to 300° C. generally are acceptable, but below the melting temperature of the polyester filaments. Satisfactory curing results are achieved by heating in an air oven at 200° C. for approximately 20 minutes.

The cured binder at the conclusion of the curing step commonly is present as a secure coating in a concentration of approximately 0.5 to 50 percent by weight of the polymeric fibers, and most preferably in a concentration of approximately 1 to 25 percent by weight of the polymeric fibers.

The present invention provides a formaldehyde-free route to form a securely bound formaldehyde-free product. The binder composition of the present invention provides advantageous flow properties, the elimination of required pH modifiers such as sulfuric acid and caustic, and improved overall economics and safety. The binder also has the advantages of being stronger and offering lower amounts of relative volatile organic content during curing, which ensures a safer work place and environment. The cure time of the binder is also faster and therefore does favor the economics while reducing the energy consumption during the curing process and lowering the carbon footprint. The binder also contains high level of sustainable raw materials further reducing the dependency to fossil based sources for the resin. Due to the hydrophobic nature of the present invention, the need for a water repellant such as silicones is eliminated or greatly reduced.

The non-woven products can be used in many different applications. Use for example in a roofing membrane is preferable as good tensile and elongation is observed. Use as a filter or a separator in battery cells are also useful applications.

The following examples are presented to provide specific examples of the present invention. In each instance the thin glass plate substrate that receives the coating can be replaced by spunbond polyester filaments or fibers. By applying the binder in the examples to spunbond polyester continuous filaments or fibers, an improved mat can be achieved. It should be understood, however, that the invention is not limited to the specific details set forth in the Examples.

Formation of Amine Salt of Inorganic Acid Intermediates:

To 1160 g of 1,6 hexanediamine dissolved in 2140 g water, 980 g phosphoric acid was added slowly and the solution was stirred for 10 min. The intermediate was labeled HP1/1.

Another intermediate was formed by dissolving 1160 g of 1,6 hexanediamine in 3120 g water. Next, 1960 g phosphoric acid was added slowly and the solution was stirred for 10 min. This intermediate solution was labeled HP1/2. The opaque amino-acid salt solution was utilized in the formation of a binder.

These intermediate amine-acid solution were utilized to make the following resins with glucose.

EXAMPLE 1

To 42.8 g of solution of HP1/1 intermediate, anhydrous dextrose and water was added. The mass of added water was chosen to be equal to that of corresponding dextrose. The mass of dextrose (and corresponding water) used was 72 g, 108 g, 144 g, 180 g, 216 g, 252 g, 288 g, 324 g, 360 g and 396 g. The various solutions were stirred at ambient temperature for 10 min. The solutions were applied as a thin film on a glass and A1 panel, dried in an oven at 100° C. for 5 min and cured at 200° C. for 20 min. Each solution gave a cured brown polymer that was hard and insoluble in water and solvents.

EXAMPLE 2

To 62.4 g of solution of HP1/2 intermediate, anhydrous dextrose and water was added. The mass of added water was chosen to be equal to that of the corresponding dextrose. The mass of dextrose (and corresponding water) used was 72 g, 108 g, 144 g, 180 g, 216 g, 252 g, 288 g, 324 g, 360 g and 396 g. The various solutions were stirred at ambient temperature for 10 min. The solutions were applied as a thin film on a glass and A1 panel, dried in an oven at 100° C. for 5 min and cured at 200° C. for 20 min. Each solution gave a cured brown polymer that was hard and insoluble in water and solvents.

EXAMPLE 3

Examples 1-2 were repeated in the presence of 5% by weight ammonium sulfate. The polymers became insoluble in water in less than 10 min.

EXAMPLE 4

In a non-limiting example, a dextrose-based binder was applied to a spunbond polyester mat for evaluation of physical properties. The binder has a composition of hexamethylenediamine/phosphoric acid/dextrose (HMDA/Phos/Dextrose) in which the molar equivalent ratios between each component are 1/2/12. The binder was diluted with tap water and applied to a spunbond mat via a dip-and-squeeze coating application. The coated mat was dried and cured in a standard convection oven set at 215° C.

The spunbond mat tensile and trap tear strengths were measured in both the machine and cross-machine directions at room temperature using a standard Instron. The binder system yielded comparable tensile strength and improved tear strength in comparison to a standard latex binder system.

The elongation of these spunbond mats were also measured at both room temperature and elevated (200° C.) temperature. The results are graphically depicted in the FIGURE of the Drawing. In the room temperature test, % tensile elongation in both the machine and cross-machine directions is determined at the maximum tensile loading. The elevated temperature % tensile elongation is determined at tensile loadings of 5, 8, and 12 daN, respectively. The binder system yielded 50-60% improvement in tensile elongation at elevated temperature while providing comparable tensile elongation at room temperature in comparison to a standard latex binder system. The overall performance of the binder is superior to any commercially available thermoplastic latex or formaldehyde-free thermosetting binder system and has the added advantage of being primarily derived from renewable raw materials.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

That which is claimed is:

1. A spunbond polyester mat comprising a binder comprised of a reaction product of an aldehyde or ketone with an amine salt of an inorganic acid, wherein the amine functionality is a di- or multifunctional primary or secondary amine.

2. The spunbond polyester mat of claim 1, wherein the inorganic acid is phosphoric acid.

3. The spunbond polyester mat of claim 1, wherein the amine is a diamine having at least one primary amine group.

4. The spunbond polyester mat of claim 3, wherein said amine is selected from the group consisting of ethylene diamine, 1,3-propanediamine, 1,4-butanediamine, 1,5-pentanediamine, 1,6-hexanediamine, α,α'-diaminoxylene, diethylenetriamine, triethylenetetramine, tetraethylenepentamine, diamino benzene and mixtures thereof.

5. The spunbond polyester mat of claim 1, wherein the acid is an oxygenated acid selected from the group consisting of phosphoric acid, pyrophosphoric acid, phosphorus acid, sulfuric acid, sulfurous acid, nitric acid, boric acid, hypochloric acid, and chlorate acid.

6. The spunbond polyester mat of claim 1, wherein the acid is a non-oxygenated acid selected from the group consisting of hydrochloric acid, hydrogen sulfide, and phosphine.

7. The spunbond polyester mat of claim 1, wherein the reaction product is that of an aldehyde with the salt.

8. The spunbond polyester mat of claim 7, wherein the aldehyde is a reducing sugar.

9. The spunbond polyester mat of claim 7, wherein the aldehyde is a reducing monosaccharide, disaccharide or polysaccharide.

10. The spunbond polyester mat of claim 9, wherein the aldehyde is glucose.

11. A process for preparing the spunbound polyester mat of claim 1, comprising coating polyester fibers or continuous filaments with a binder composition comprising a reaction product of an aldehyde or ketone with an amine salt of an inorganic acid.

12. The process of claim 11, wherein the amine is a diamine having at least one primary amine group.

13. The process of claim 12, wherein said amine is selected from the group consisting of 1,2-ethylenediamine, 1,3-propanediamine, 1,4-butanediamine, 1,5-pentanediamine, 1,6-hexanediamine, α,α'-diaminoxylene, diethylenetriamine, triethylentetramine, tetraethylenepentamine, and mixtures of these.

14. The process of claim 11, wherein the acid is phosphoric acid.

15. The process of claim 11, further comprising curing the binder composition.

16. The process of claim 11, wherein the binder further comprises a salt of a strong acid.

17. The spunbond polyester mat of claim of 1, wherein the mat is a filter.

18. The spunbond polyester mat of claim of 1, wherein the mat is a battery separator.

19. A roofing membrane comprising the spunbond polyester mat of claim of 1.

* * * * *